United States Patent [19]

Chamberlin et al.

[11] Patent Number: 4,697,993

[45] Date of Patent: Oct. 6, 1987

[54] FLUID MEDIUM COMPRESSOR AND USER APPARATUS

[75] Inventors: Edward B. Chamberlin, Short Hills; Edward M. Brown, Livington; Edward J. Towns, Morristown, all of N.J.

[73] Assignee: Spray-All, Inc., Millburn, N.J.

[21] Appl. No.: 640,082

[22] Filed: Aug. 10, 1984

Related U.S. Application Data

[63] Continuation-in-part of Ser. No. 523,127, Aug. 15, 1983, Pat. No. 4,631,003.

[51] Int. Cl.[4] ..... F04B 7/00

[52] U.S. Cl. ..... 417/514; 239/359; 239/373; 200/327

[58] Field of Search ..... 417/514, 511, 513, 552, 417/510, 512; 403/141; 200/322, 327, 328, 43.16, 43.17, 43.18, 43.11, 61.7, 61.76; 239/373, 346, 359, 340

[56] References Cited

U.S. PATENT DOCUMENTS

| | | | |
|---|---|---|---|
| 449,333 | 3/1891 | Robinson | 417/513 |
| 1,275,546 | 8/1918 | Fleming | 417/511 |
| 1,409,954 | 3/1922 | Johnston | 403/141 |
| 1,449,034 | 3/1923 | Calaway | 403/141 |
| 1,970,260 | 8/1934 | Tubbs et al. | 417/511 |
| 2,558,312 | 6/1951 | Nisbet | 417/511 |
| 3,109,384 | 11/1963 | Adams | 417/511 |
| 3,260,463 | 7/1966 | Giovansanti et al. | 239/373 |
| 3,465,952 | 9/1969 | Smith et al. . | |
| 3,652,188 | 3/1972 | Uchiyama | 417/511 |
| 3,820,722 | 6/1974 | Jett et al. | 239/373 |
| 3,871,782 | 3/1975 | Johansson et al. | 403/122 |
| 4,068,109 | 1/1978 | Hall | 200/327 |
| 4,111,570 | 9/1978 | Morel | 403/141 |
| 4,155,509 | 5/1979 | Koyama | 239/373 |
| 4,204,645 | 5/1980 | Hopp | 239/346 |
| 4,222,525 | 9/1980 | Hildebrandt | 239/346 |
| 4,301,971 | 11/1981 | Cornelius et al. | 239/373 |

FOREIGN PATENT DOCUMENTS

| | | | |
|---|---|---|---|
| 563428 | 9/1923 | France . | |
| 48560 | 9/1919 | Sweden | 417/514 |

*Primary Examiner*—Cornelius J. Husar
*Assistant Examiner*—Peter M. Cuomo
*Attorney, Agent, or Firm*—Lewis H. Eslinger

[57] ABSTRACT

A fluid medium pump includes a piston having a hollow interior for receiving a connecting rod adapted to open and close a passage through the piston selectively in accordance with the sense of movement of the rod. The connecting rod includes a groove that opens and closes the passage on the piston's compression stroke and opens the passage on the piston's return stroke. User apparatus includes the pump and various pump heads for effecting spraying, foaming and container pressurization. A control mechanism for pump operation renders the pump inoperative for transport, selectively operable upon triggering or continuously operable.

8 Claims, 27 Drawing Figures

FIG. 15
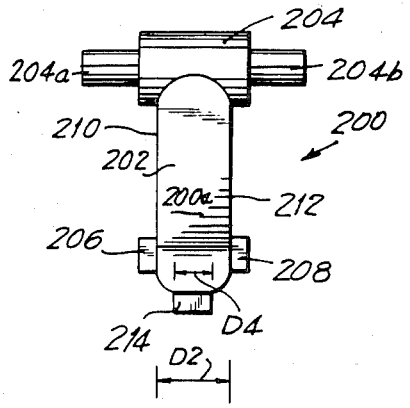
FIG. 16
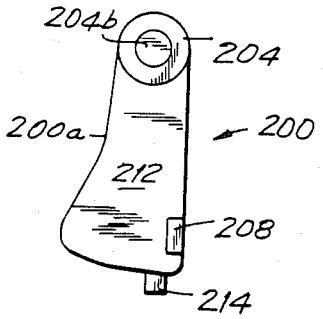
FIG. 17
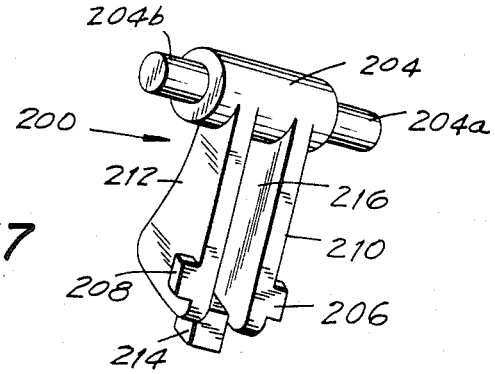
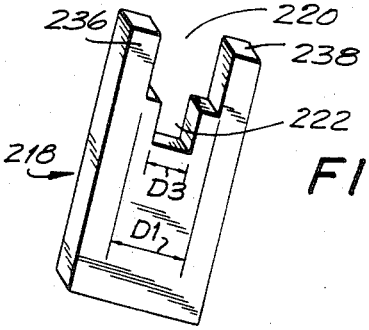
FIG. 18
FIG. 19
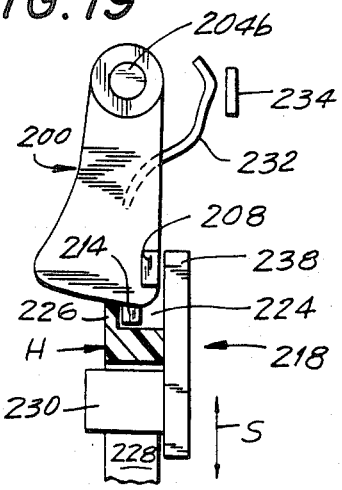
FIG. 20
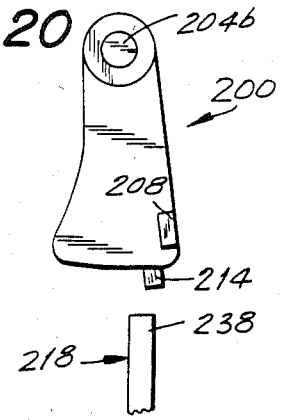
FIG. 21
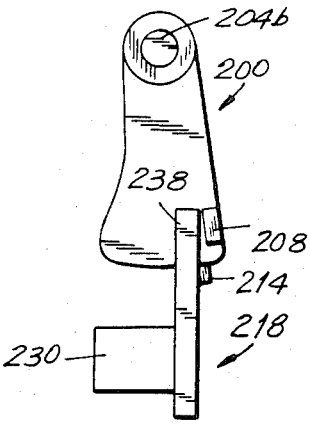

FLUID MEDIUM COMPRESSOR AND USER APPARATUS

CROSS-REFERENCE TO RELATED APPLICATIONS

This application is a continuation-in-part of co-pending prior U.S. patent application Ser. No. 523,127, filed Aug. 15, 1983, now U.S. Pat. No. 4,631,003 and assigned to the assignee of the present invention.

FIELD OF THE INVENTION

This invention relates to apparatus for compressing fluid medium and articles including same and pertains more particularly to air pumps of light weight and mechanical simplicity.

BACKGROUND OF THE INVENTION

Functions required in fluid medium compression include the intake of a high volume of medium at low, typically ambient, pressure, compression of the medium into low volume and consequent higher pressure and issuance or outlet of the medium at such higher pressure. These functions are realized mechanically in known apparatus by a housing supporting a piston for movement in a compression chamber, inlet and outlet ports and suitable valving and control mechanism for operating the valves.

In a quite simple type of air pump, wide variations of which are known, a translatory piston defines a compression surface in which a one-way valve is supported. The valve is typically a flap member on the compression surface overlying an opening therein which extends through the piston into fluid communication with the housing intake port. On the piston compression stroke, the flap is maintained flush with the compression surface and functions therewith to compress air in the compression chamber. On the piston return stroke, the flap is opened by pressure differential, since the return stroke creates subambient pressure in the compression chamber, and ambient air flows from the housing intake port through the open flap valve into the compression chamber, readying the pump for the next compression stroke.

In the described apparatus, disadvantage exists in manufacture based on the need for attachment of the flap to the compression surface for movment, in pressure loss through the flap attachment structure and in need for replacement of the flap and/or its attachment structure in the course of usage.

Some effort is seen in the prior art which would avoid the foregoing disadvantages attending flap valve air pumps or like pumps having valved pistons. In U.S. Pat. No. 3,716,310 a fluid compressor includes a "dissociating" piston having a first compression surface-defining portion in the form of a truncated sphere and a second portion movable relative to the first portion to escape from sealed contiguity therewith and hence to place fluid flow passages of the second portion in communication with the compression chamber. Biasing means is included to sealingly mate the two piston portions. In the course of the return stroke in the '310 pump, it appears that inertia of the first portion causes it to lag and thus separate somewhat, overcoming the biasing means, from the positively-displaced second portion, whereby the compression chamber is replenished with ambient air. A point is reached at which the biasing means returns the two portions into mated relation, whereupon the compression stroke commences.

As in the first discussed generally known pump with flap valve, resilient means again is present in the '310 pump as an operative element in valving function and pumping constancy is dependent thereon, efficiency lessening as the resilient means wears. Pump assembly is relatively complex and resilient part wear and replacement are again present.

SUMMARY OF THE INVENTION

The present invention has as its object the provision of improved simplified fluid medium compression apparatus.

A more particular object of the invention is to provide an air pump effecting air intake to the pump compression chamber without requirement for piston-additive biasing means.

Another object of the invention is to provide user articles incorporating improved fluid medium compression apparatus.

An additional object of the invention is to provide simplified control mechanism for operating fluid medium compression apparatus.

In achieving these and other objects, the invention provides a pump having a piston with a fluid flow passage extending through its compression surface and drive means and a driven member operative to displace the piston in return and compression strokes, wherein the driven member has a flow conduit therein in flow communication with the pump inlet port and is operative to selectively place such conduit in and out of flow communication with the piston passage respectively in the return and compression strokes.

In a preferred embodiment, the piston includes an interior hollow and the driven member includes a connecting rod having an end portion retained in the piston hollow. During the compression stroke, such rod end portion interrupts flow communication between the piston passage and the driven member conduit. At the outset of the return stroke, the rod end portion is translated relative to the piston, thereby providing flow communication between the piston passage and driven member conduit, and such condition continues throughout the remainder of the return stroke during which the rod end portion also displaces the piston.

In such preferred embodiment, the piston includes an interior hollow which is generally spherical and the rod end portion includes spaced disc-shaped segments slidingly engaging the spherical piston surface bounding the hollow, whereby a universal joint is provided as between the piston and connecting rod. The fluid conduit through the rod end portion is defined collectively by the free spaces or subconduits between adjacent ones of the disc-shaped segments, such that return stroke drag is minimized and the pump, so to speak, "breathes" substantially freely throughout the return stroke.

In its user apparatus aspect, the invention provides a variety of pump heads for use with its pump and operative for spraying, pressurizing, foam dispensing, fluid dispensing and like purposes.

In its control mechanism aspect, the invention enables intermittent operator pump control, continuous pump operation and safety transport of the pump in secured inoperative condition.

The foregoing and other objects and features of the invention will be further understood from the following detailed description of preferred embodiments and practices and from the drawings wherein like reference numerals identify like parts throughout.

DESCRIPTION OF THE DRAWINGS

FIG. 15 is a front elevation of an operating button for a pump in accordance with the invention.

FIG. 16 is a side elevation of the FIG. 15 button.

FIG. 17 is a rearward perspective view of the FIG. 15 button.

FIG. 18 is a perspective view of a control slide for use with the FIG. 15 button.

FIG. 19 is a partial sectional view of a pump casing with the operating button and control slide in respective first positions.

FIGS. 20 and 21 shows the operating button and control slide in other positions.

DESCRIPTION OF PREFERRED EMBODIMENTS AND PRACTICES

Figure 1:
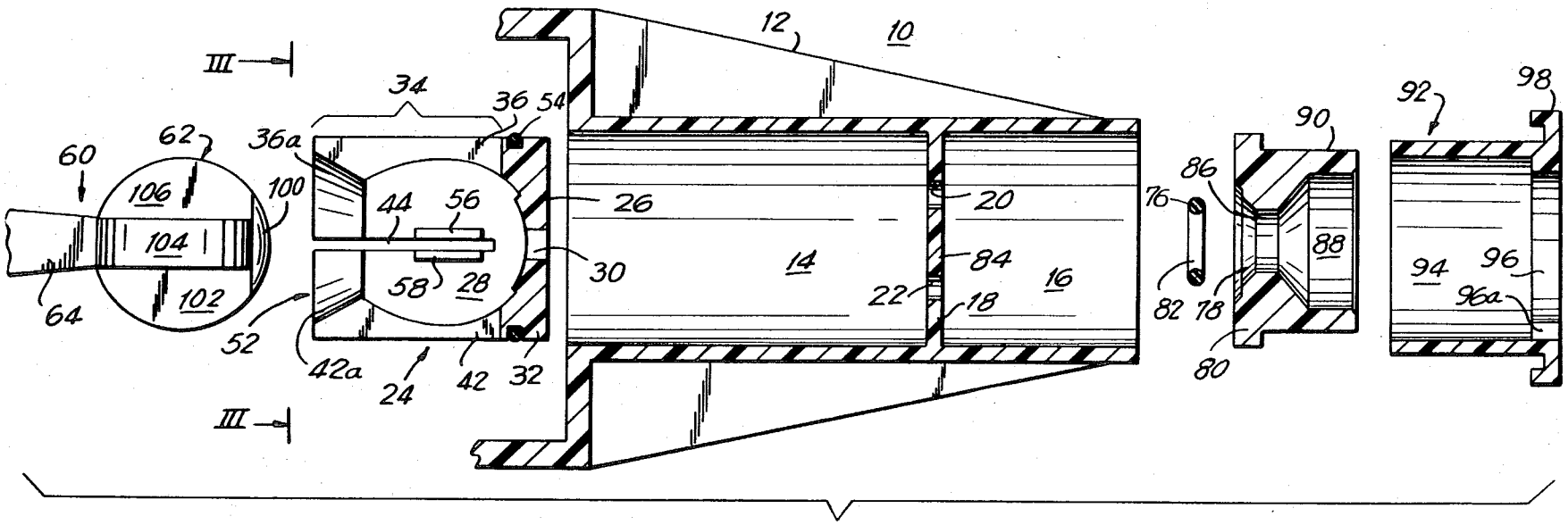
FIG. 1 is an exploded view of components of a pump in accordance with the invention.
Figure 2:
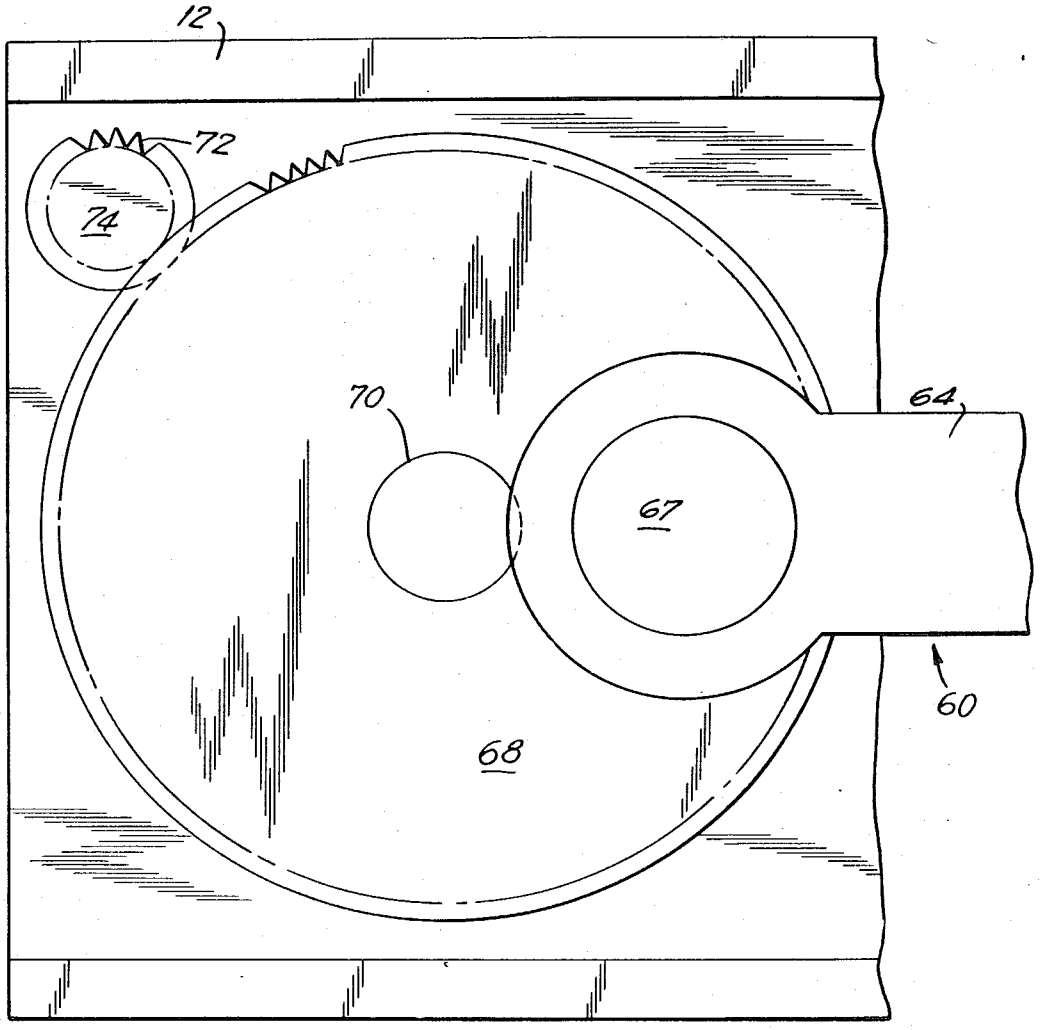
FIG. 2 is partial plan view of drive means for the FIG. 1 pump.

Referring to FIGS. 1 and 2, pump 10 includes housing 12 having interior cylindrical compartments 14 and 16 separated by crossplate 18 through which extend passages 20 and 22 for fluid communication between compartments 14 and 16. Housing 12, and all other pump components to be discussed, are formed of plastic materials, unless otherwise noted below.

Figure 3:
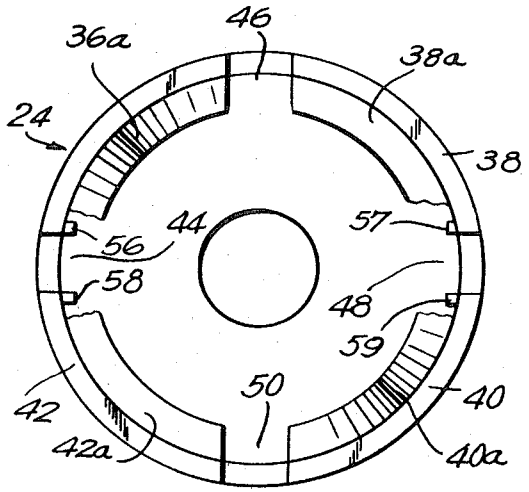
FIG. 3 is a view of the piston of the FIG. 1 pump as would be seen from plane III—III of FIG. 1.

Considering the left side of the exploded view of FIG. 1, piston 24 defines compression surface 26 and an interior hollow 28 bounded by surface 26, passage 30 extending from the hollow through piston head portion 32 and compression surface 26. The hollow is generally spherical as indicated, being bounded by piston tail portion 34, which has four sections 36, 38, 40 and 42 (FIG. 3) which are mutually separated by slits 44, 46, 48 and 50 and which are cantilever-supported by piston head portion 32 and are mutually resiliently displaceable. Sections 36, 38, 40 and 42 include tapered ends 36*a*, 38*a*, 40*a* and 42*a*, to provide a generally conical opening 52 into piston 24. Piston head portion 32 includes a circumferential channel for seating sealing ring 54. Piston tail portion 34 includes ribs 56, 58, 57 and 59 (FIG. 3) in it hollow bounding surface 28, for purpose discussed below. FIG. 3 is partly broken away to show ribs 56–59.

Connecting rod or driven member 60 includes an end portion 62 configured to reside in the piston hollow, the end portion configuration being discussed in detail below in connection with FIGS. 5–8. Rod member 64 extends axially from end portion 62 and includes an opening in registry with metal pin 67 FIG. 2 upstanding on driven gear 68. Gear 68 seats on a central metal pin 70 supported for rotation in housing 12. Drive gear 72 of metal is in mesh with driven gear 68, its drive shaft 74 being rotated by a suitable drive motor (not shown) also supported in housing 12.

Figure 4:
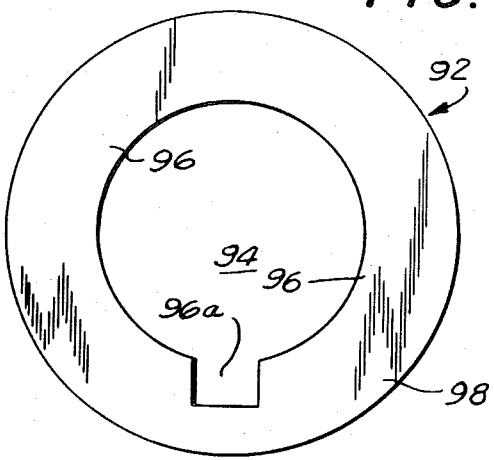
FIG. 4 is a view of the end cap of the FIG. 1 pump as would be seen from plane IV—IV of FIG. 1.

Turning to the right side of the exploded view of FIG. 1, O-ring 76 is of such dimensions as to nest against conical inlet 78 of output 80 and as to have its open interior 82 nest against central expanse 84 of crossplate 18, upon pump assembly. Unit 80 includes outlet passage 86 and tapered/flat seat 88, and is stepped at 90 for sliding receipt thereon of end cap 92. End cap 92 (FIGS. 1 and 4) has a central bore 94, open end wall 96 having key slot 96*a* and mounting flange 98.

Figure 6:
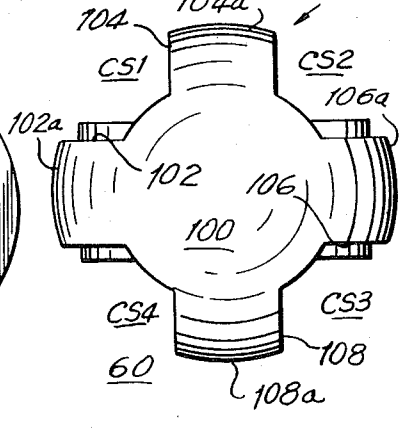
FIG. 6 is a left side elevation of FIG. 5.
Figure 5:
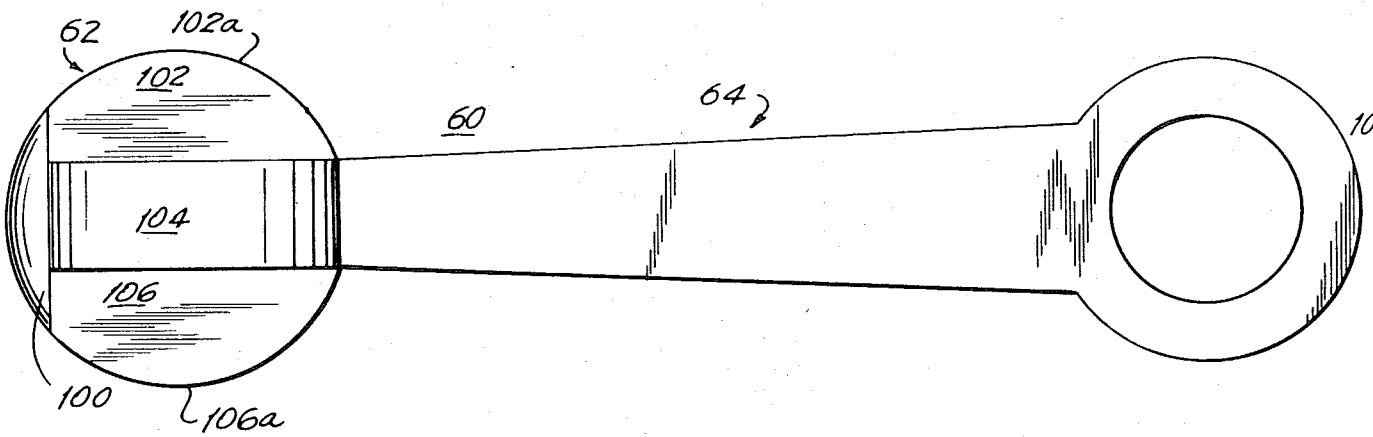
FIG. 5 is a top plan view of the connecting rod of the FIG. 1 pump.
Figure 8:
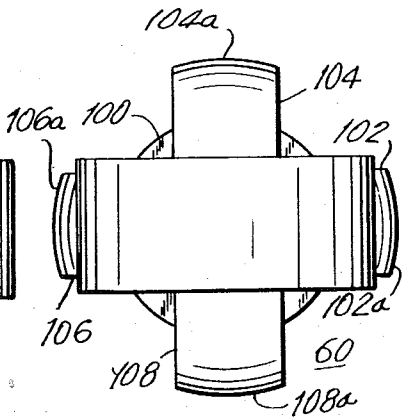
FIG. 8 is a right side elevation of FIG. 7.
Figure 7:
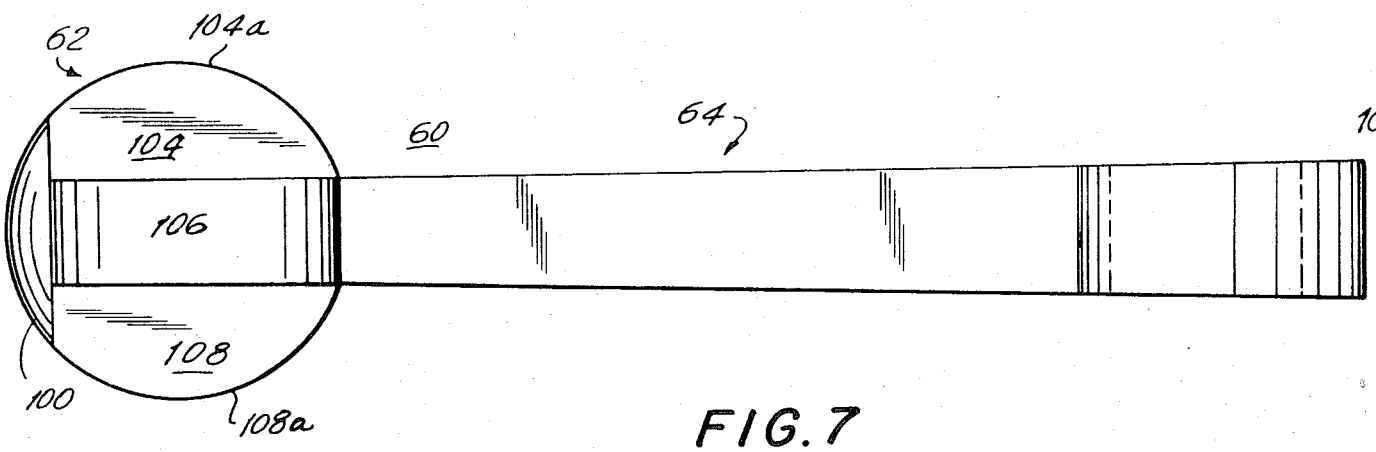
FIG. 7 is a front elevation of FIG. 5.

Referring now to FIGS. 5–8, connecting rod 60 has a truncated spherical section 100 in its end portion 62 from which disc-shaped segments 102, 104, 106 and 108 extend radially with such sphere to bearing surfaces 102*a*, 104*a*, 106*a*, 108*a*, the spherical curvature of which tracks that of the bounding surface of piston hollow 28 (FIG. 1), with two exceptions noted below. Thus, the surface curvature of the segments is both as is seen in FIGS. 6 and 8 and also as is evident from FIGS. 5 and 7, where it is shown that each of surfaces 102*a*, 104*a*, 106*a* and 108*a* defines, with sperical section 100, a semicircle in the direction of the longitudinal axis of rod member 64. The entirety of connecting rod 60 is preferably formed as an integral molded member.

Figure 9:
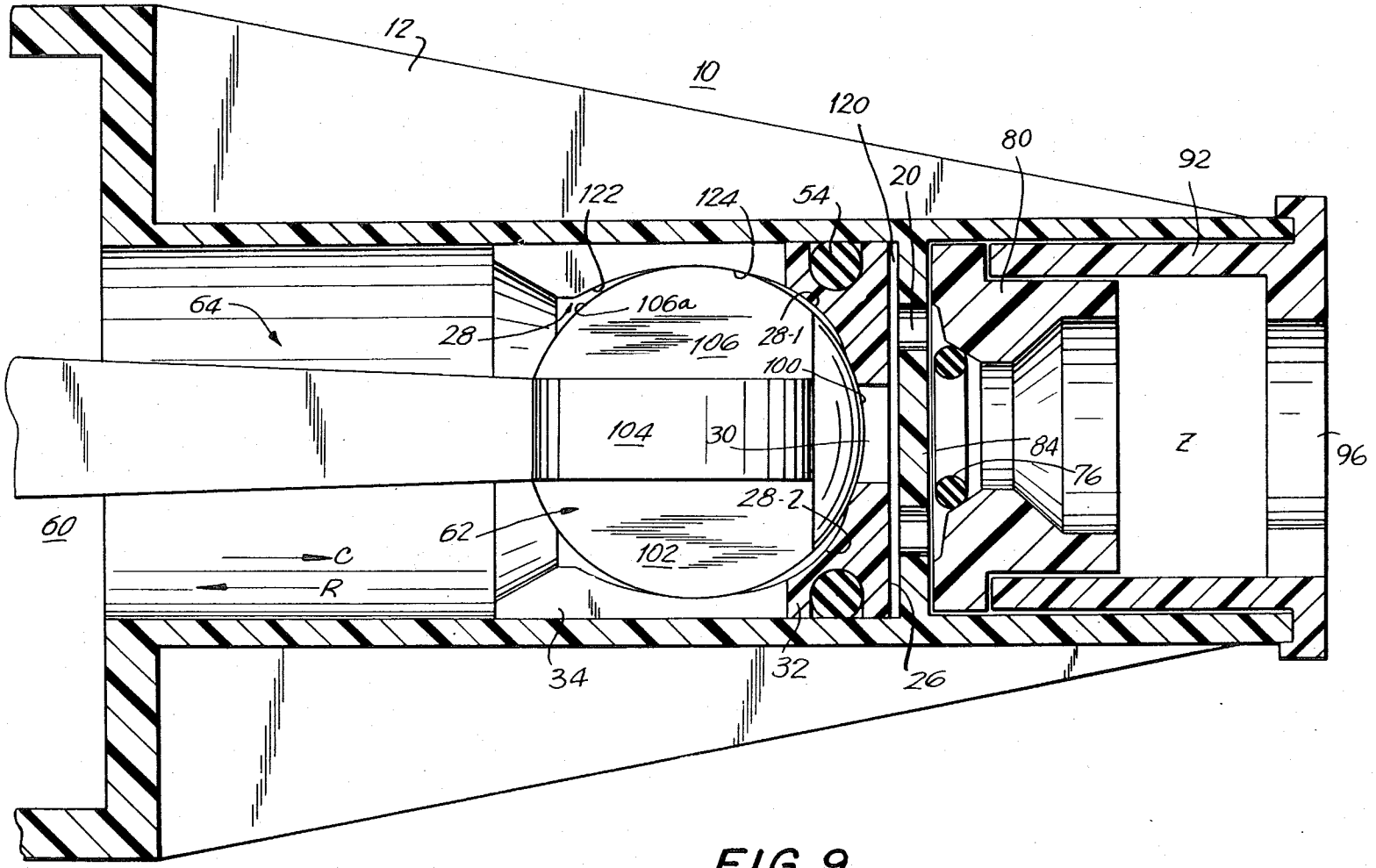
FIG. 9 is a partial sectional view of the the components of FIG. 1 as assembled and in the course of a compression stroke.

In FIG. 9, the components of FIGS. 1 and 3–8 are shown in assembly, with all components other than connecting rod 60 sectioned as in FIG. 1. Rod 60 is movable in first and second opposite senses C (compression) and R (return), as indicated by the arrows in FIG. 9. In its FIG. 9 disposition, rod 60 is depicted in a compresson stroke, nearing its rightwardmost point of travel. Since rod 60 travel is in compression sense, truncated spherical section 100 of rod end portion 62 is in contiguity with piston head 32 and fluid communication between passage 30 and the interior hollow 28 of piston 24 is interrupted, i.e., precluded until renewed. Compression chamber 120 volume is quite low and air present therein is at elevated pressure, approaching the preselected pressure level at which the force imposed upon ring 76 will compress the same radially inwardly and out of sealing engagement with the inlet of output unit 80. At that juncture, pressurized air at such preselected level issues into output unit 80 for use by whatever utilization device wich may be present in zone Z discussed below in connection with FIGS. 11 and 12. Reference is made to U.S. Pat. Nos. 3,592,244 and 4,033,511 for further discussion and illustration of such O-ring type of pressurized air output valve.

The first exception noted above, as respects the mutual tracking of surfaces of rod 60 and piston interior surface 28, is that surface 28 is spherical adjacent passage 30, but runs outwardly of such sphere over extents 28-1 and 28-2 and then returns to spherical mutuality with rod 60 surfaces 102*a*, 104*a*, 106*a* and 108*a*. The benefit involved in such configuration of surface 28 is that the available sealing force as between section 100 of rod 60 and surface 28 is maximized on a p.s.i. basis by minimizing the interfitting surface areas. In the FIG. 10 disposition of the assembled pump, rod 60 is depicted substantially into its return stroke. At the outset of the return stroke, rod end portion 62 is displaced relative to piston 24 by reason of the second exception above noted as respects the mutual tracking of surfaces of rod 60 and piston interior surface 28, i.e., disparate curvatures as between the mating surfaces, as shown for surface 106*a* and portion 122 on surface 28 in FIG. 9. The surface 28 bounding the piston hollow is radially enlarged in its leftward portion, as at 122.

Following such outset movement of rod end portion 62 relative to piston 24, by which passage 30 is placed in or renews flow communication with the piston hollow, rod 60 and piston 24 move jointly throughout the remainder of the return stroke. Fluid flow during the return stroke is from the ambient environment or other source through inlet port 126 (FIG. 10), through conduit segments or subconduits CS1, CS2, CS3 and CS4 (FIGS. 6 and 8), through the piston hollow and through passage 30 into now expanded compression chamber 120 (FIG. 10).

Subconduits CS1–4 collectively define a substantially open conduit through rod end portion 62, giving rise to quite free, low drag displacement of piston 24 in its return stroke and the foregoing expression that the pump "breathes".

Figure 10:
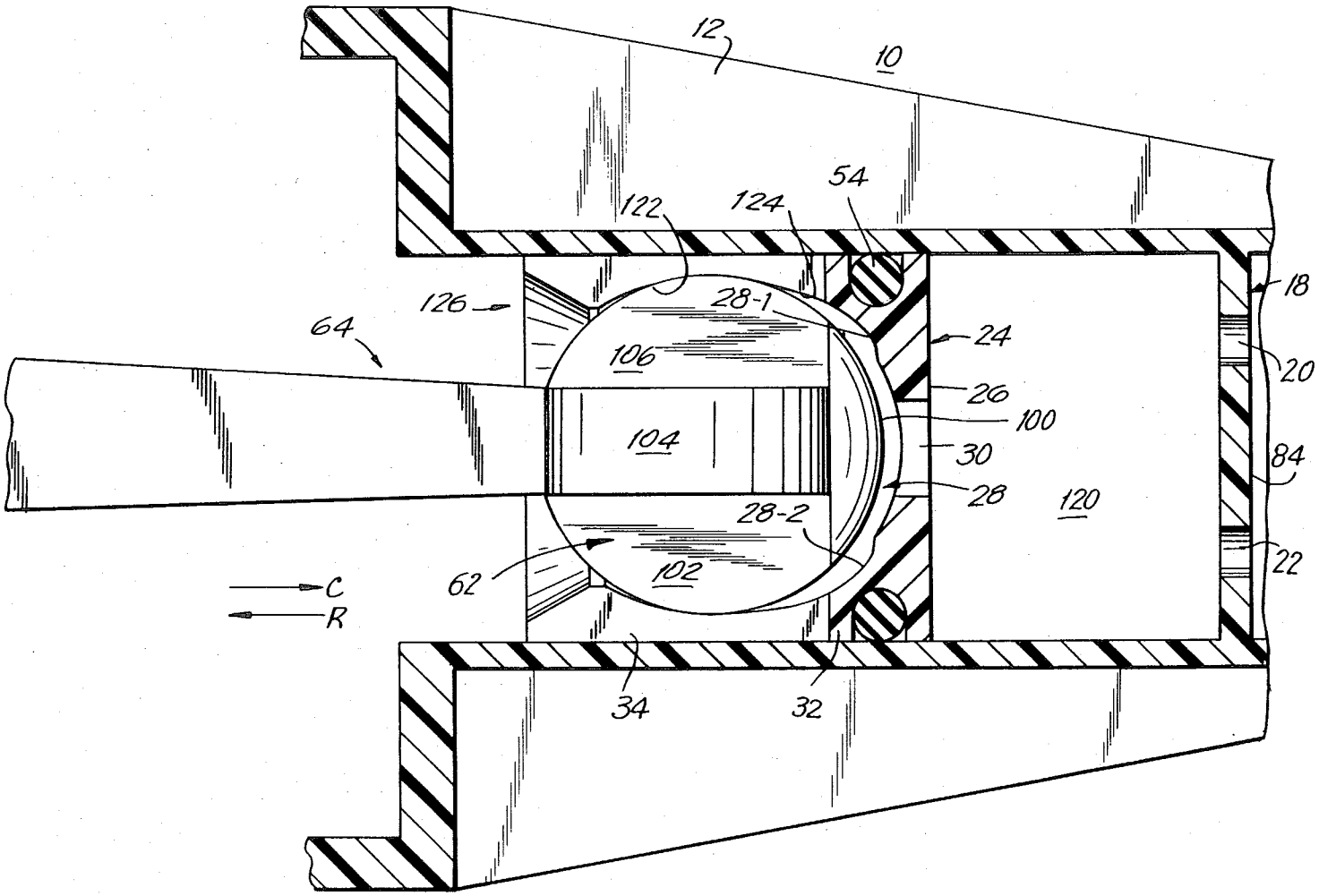
FIG. 10 is a partial sectional view of the components of FIG. 1 as assembled and in the course of a return stroke.

In reaching the pump assembly shown in FIGS. 9 and 10, one first assembles rod 60 with piston 24. This assembly is facilitated by the cantilever-supported sections 36–42 (FIG. 3) of piston tail portion 34 (FIG. 1). Thus, rod end portion 62 is forced into opening 52 of piston 24 and sections 36–42 flex outwardly to permit entry of rod end portion 62 into the piston hollow. As residence occurs, sections 36–42 snap onto the then-retained rod end portion. This assembly is then moved into compartment 14 (FIG. 1) and the remaining components are then assembled into compartment 16. The components placed in compartment 16 (FIG. 1) are secured therein by joining the plastics of member 92 and housing 12 in the interior of compartment 16. Openings 20 and 22 of FIG. 1 are two of six equally circumferentially spaced openings.

As will be appreciated, the arrangement of disc segments 102, 104, 106 and 108 and the spherical piston surface 28 bounding the piston functions, beyond the conduit-defining aspect discussed above, to provide a universal joint as between rod 60 and piston 24, thus eliminating need for the customary wrist pin or other equivalent assembly device and step. Also, valving for compression and return strokes is effected without piston-additive biasing means or the like. Ribs 56–59 engage rod end portion 62 in the course of its rotational movement to limit such movement and prevent rod 60 from entering into grooves 44–50.

Figure 11:
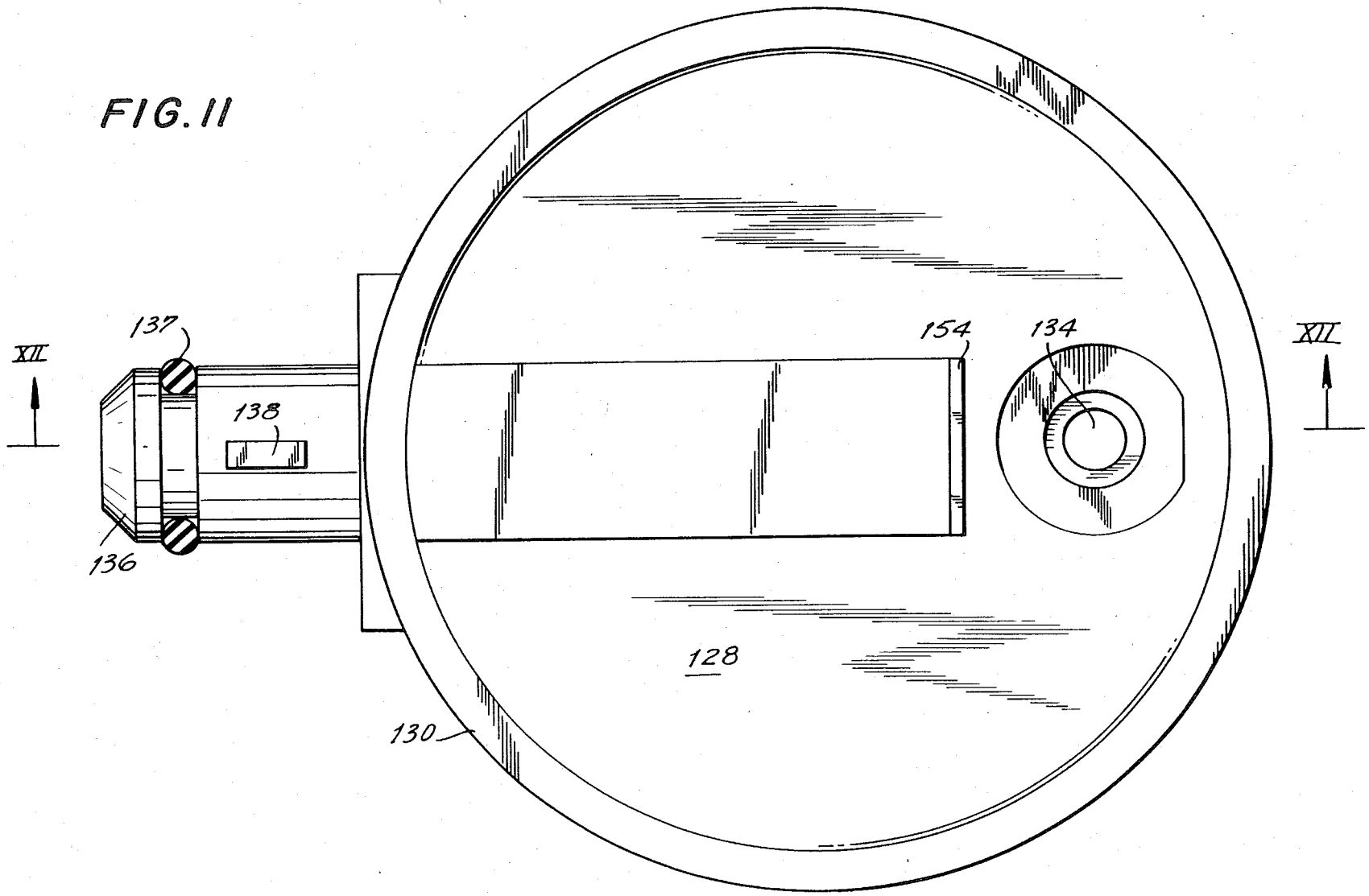
FIG. 11 is a top plan view of a spray head for use with FIG. 1 pump, with its nozzle unit removed.
Figure 12:
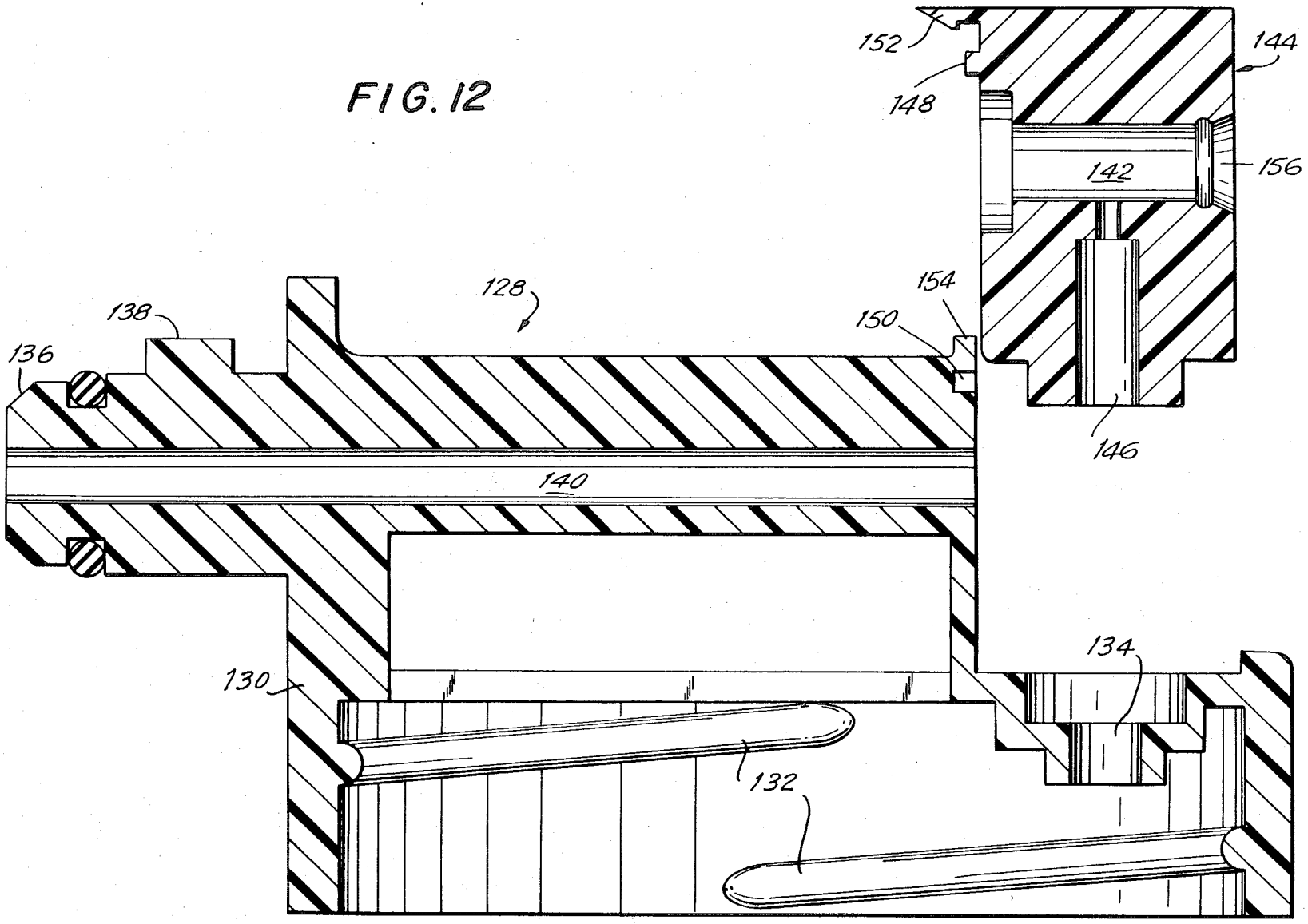
FIG. 12 is a sectional view of the FIG. 11 spray head and a nozzle for assembly therewith as would be seen from plane XII—XII of FIG. 11.

In typical application of the pump discussed to this point, pressurized air issuing from output unit 80 is fed to apparatus using same to draw content from a container of paint or the like through use of structure seated in zone Z of FIG. 9. Suitable such structure is shown in FIGS. 11 and 12. Spray head 128 includes skirt 130 which is interiorly threaded as at 132 for releasable securement to a container or canister (not shown). Outlet port 134 is provided upwardly of skirt 130. Fitting 136 is formed in upper structure of spray head 128 and is configured to nest in seating 88 of pump output unit 90. O-ring 139 is seated in fitting 136. Rib 138 is dimensioned to enter through key 96*a* (FIG. 4) of end cap 92 and to be secured by the end cap on rotation of the pump.

Passage 140 extends through spray head 128 and issues pressurized air into passage 142 of nozzle unit 144, when the nozzle unit is assembled with spray head 128. This assembly is done by registering venturi tube 146 with outlet port 134, registering nipple 148 in slot 150 and placing latch 152 over post 154. As pressurized air flows through passage 142, the contents of the container are drawn through venturi 146 into passage 142 to be admixed with the air and dispensed in atomized manner through outlet nozzle 156.

Figure 13:
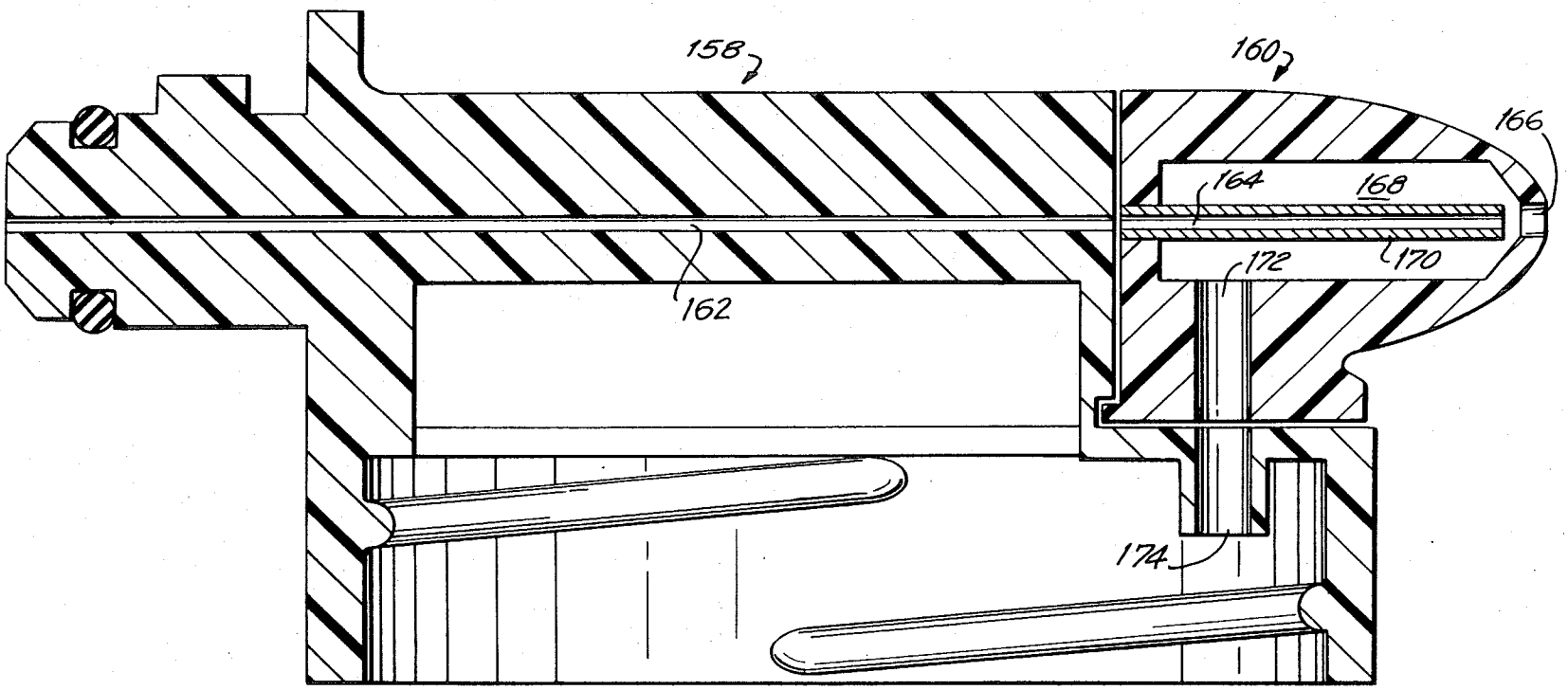
FIG. 13 is a sectional view of a further embodiment of sprayhead and nozzle in accordance with the invention.

FIG. 13 depicts a further spray head 158 configured generally as in the FIG. 12 embodiment. Nozzle unit 160 differs from nozzle unit 144 of FIG. 12 in various respects. Passage 162 of head 158 communicates with passage 164 of nozzle unit 160 and passage 164 issues in spaced relation to outlet nozzle 166. An enlarged channel 168 circumscribes wall 170 of passage 164 and communicates with passage 172. Passage 172 registers with outlet duct 174 of sprayhead 158. Ends of passages 164 and 168 are in facing relation to nozzle. Wall 170 is the shell of a metal tube secured in nozzle unit 160. The FIG. 13 unit is assembled with a canister, whose contents are drawn through duct 174 and passage 172 to be admixed with air issuing from passage 164 and are dispensed in atomized manner through outlet nozzle 166.

Figure 14:
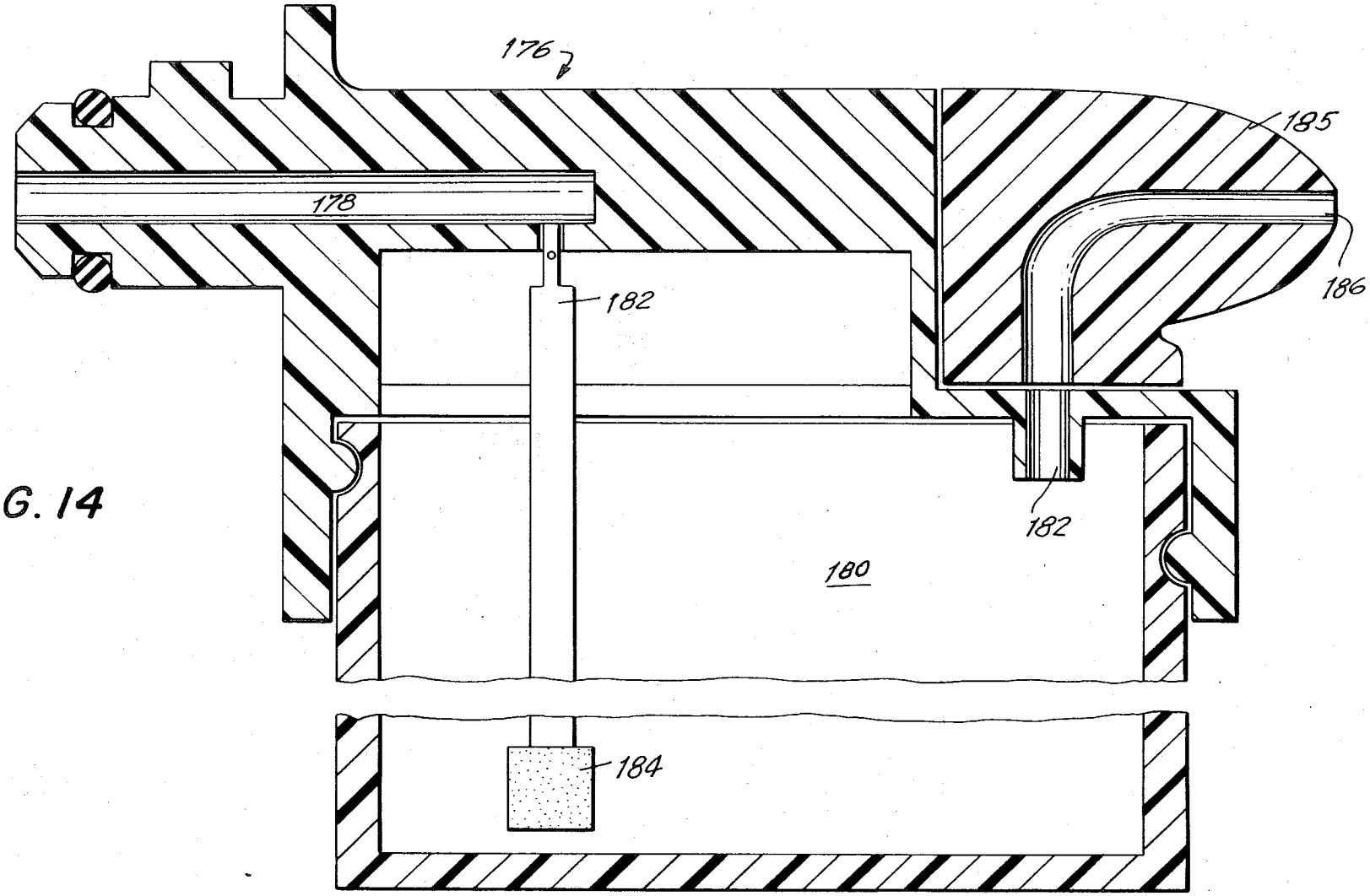
FIG. 14 is a sectional view of a pump head and canister for use in foaming and foam delivery.

In pump head 176 of FIG. 14, passage 178, which receives the pump output, terminates within pump head 176 and communicates with the interior of canister 180 through pipe 182, which is secured to pump head 176. Pipe 182 feeds aerator unit 184, which may be of type commercially found in fish tanks and serving to so issue air throughout its surface as to cause air entrapment bubbles in a medium in canister 180, such as foamable liquid. The thus foamed liquid issues from canister 180 through duct 182 and then from foam head 184 through passage 186 thereof.

In alternate use of the FIG. 14 pump head, one can omit the pipe and aerator unit and apply a valve to duct 182, in which event the apparatus serves to pressurize canister 180 when the valve is closed. Pressurized air may be selectively issued from the canister upon opening the valve.

Figure 14A:
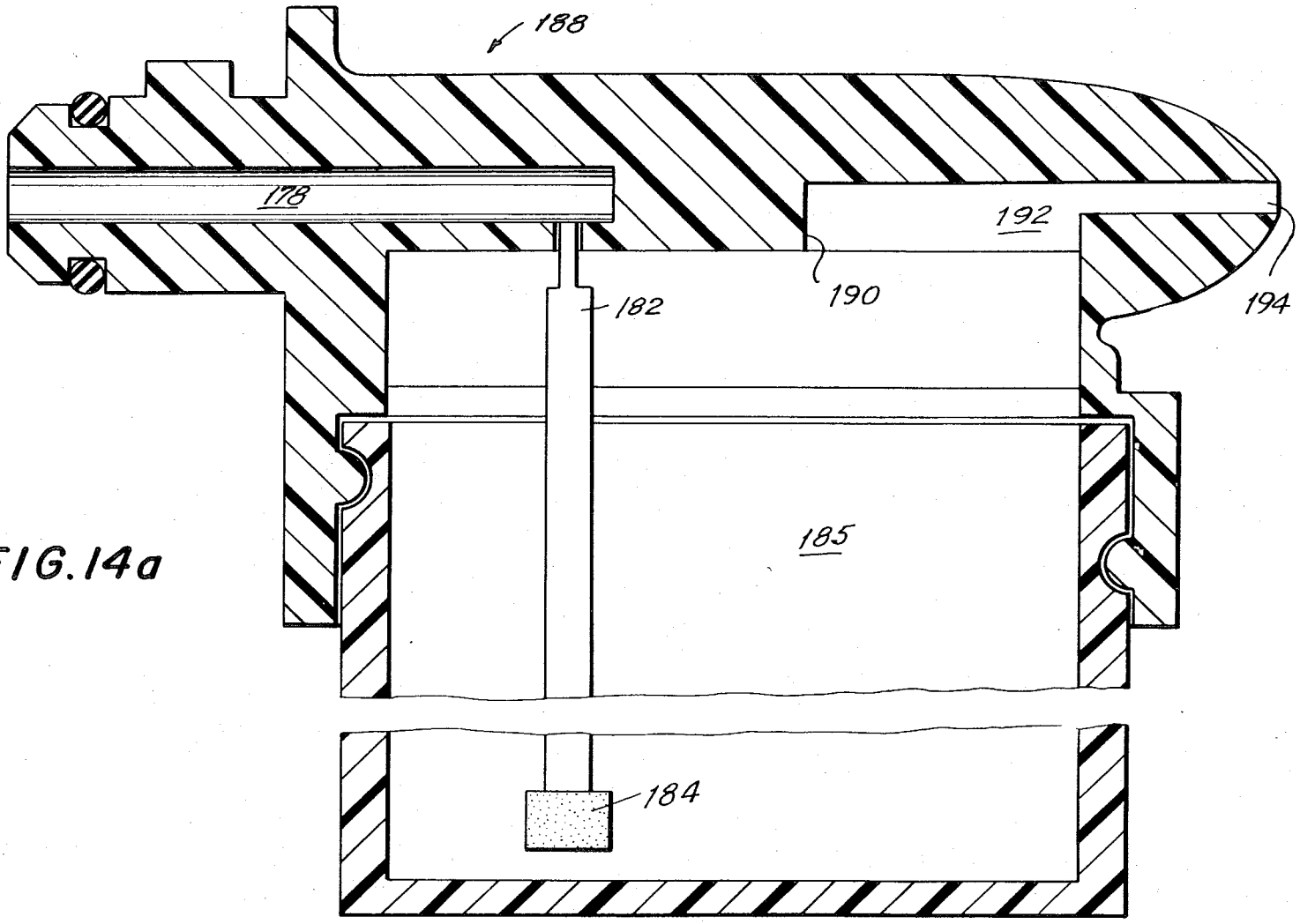
FIG. 14*a* is a sectional view of an alternate arrangement for use in foaming and foam delivery.

Pump head 188 of FIG. 14*a* has some structure in common with the FIG. 14 head, namely, passage 178 and pipe 182. The FIG. 14*a* head differs in incorporating its issuance structure as an integral part thereof, rather than as a separable nozzle unit. In its rightward portion, head 188 thus includes undercut 190, which forms a channel 192 opening along its length into canister 185. Channel 192 communicates with outlet passage 194, from which foamed substance issues on the supply of pressurized fluid medium to passage 178.

Figure 14B:
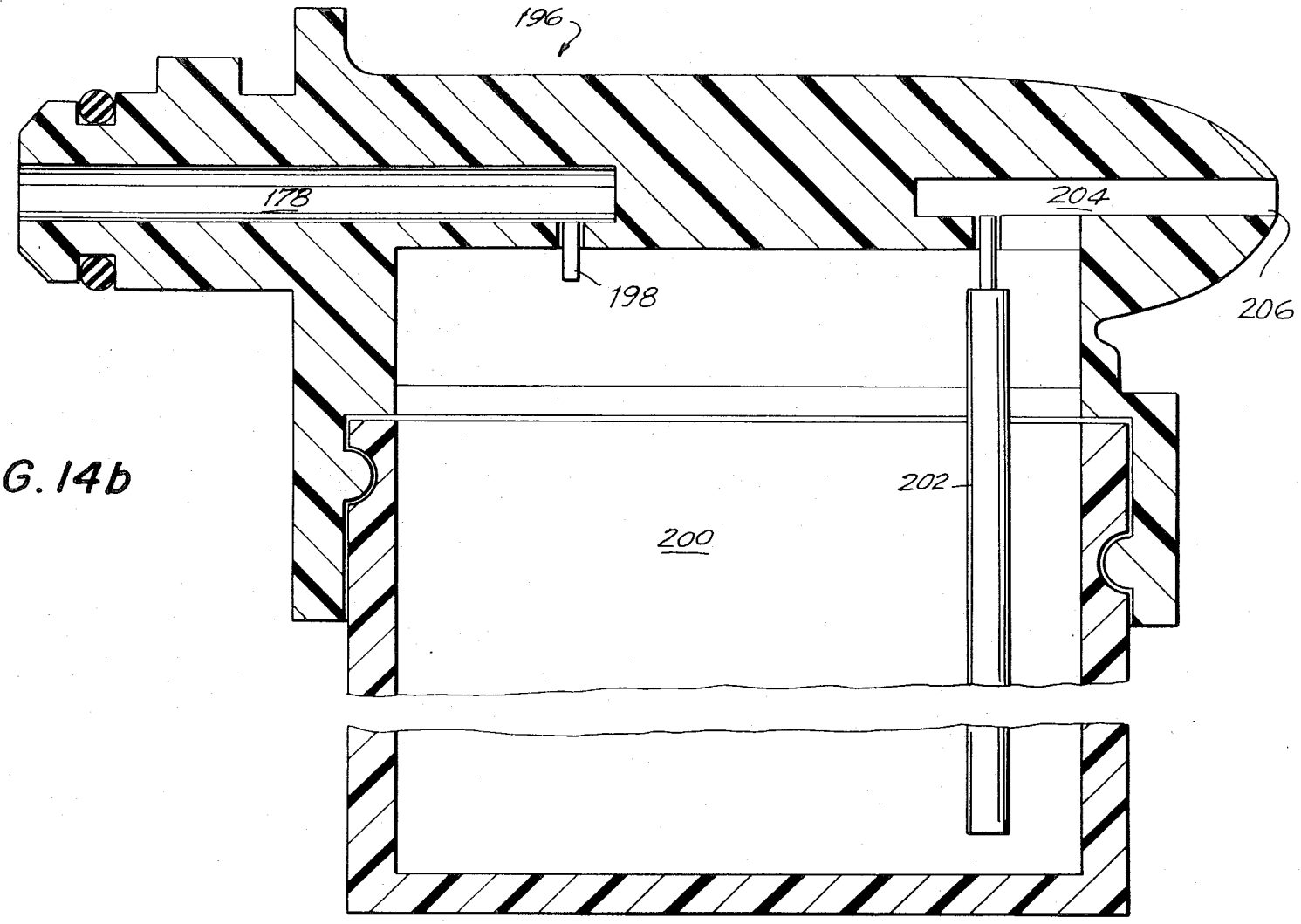
FIG. 14*b* is a sectional view of a pump head and canister for the dispensing of fluid medium.

In the pump head 196 of FIG. 14*b*, passage 178 communicates with conduit 198 in turn in communication with canister 200. Pipe 202 extends from outlet channel 204 to the lower portion of canister 200. Upon pressurization of the upper portion of canister 200 by conduit 198, fluid medium in canister 200 issues through pipe 202, passage 204 and outlet 206.

Referring to FIGS. 15–17, pump operating button or switch operator 200 of a switching controller has a centerbody 202 with integral shaft 204 at its upper portion to provide rotational (pivotal) support for button 200 upon seating of shaft ends 204*a* and 204*b* in housing journals (not shown). Ears 206 and 208 extend outboard of the lateral sides 210 and 212 of button 200. Extending downwardly from the lower portion of centerbody 202 is retention lug 214 which is at a location forwardly of ears 206 and 208 toward touch surface 200*a* of button 200. A rearward recess 216 FIG. 17 is formed in button 200 for residence of an extent of an electrical contact.

Control slide 128 (FIG. 18) of the switching controller is a generally flat member having an uppermost opening 220 of dimension D1, slightly greater than the spacing D2 between ears 206 and 208 (FIG. 15). A succeedingly upper opening 222 is of dimension D3, slightly greater than the width D4 of lug 214 (FIG. 15).

As is shown in FIG. 19, apparatus housing H, which encloses and supports pump housing 12 (FIG. 1), has a recess 224 formed therein to receive lug 214 when button shaft ends 204*a* and 204*b* are journalled in the housing. Recess 24 is bounded in part by housing front wall 226 which prevents button 200 from exiting the housing since same is in position preventing clockwise rotation of button 200 from its FIG. 19 disposition by confronting relation of wall 226 to lug 214.

FIG. 19 further shows the control slide 218 in housing H as being slidably displaceable along track 228 in the directions indicated by the arrow designated S. Slide operator 230 extends leftwardly beyond housing H to be moved by an operator.

In the FIG. 19 mutual orientation of button 200 and slide 218, the former is in its first disposition (switch inoperative state) wherein contact 232 is out of electrical engagement with its mating contact 234, typically the casing of an electric motor for driving the pump. One end of the motor winding is connected to the casing. The other end of the motor winding and contact 232 are connected to opposite polarity terminals of a battery. Button 200 is constrained against counterclockwise rotation from such first disposition, since ears 206 and 208 are confronted by slide lugs 236 and 238. Slide 218 is in its upper position in interfering relation to pivotal movement of button 200. This is a safety state of button 200 and slide 218 and the pump may be transported without concern for it becoming operative.

In FIG. 20, slide 218 is shown in its downward position, i.e., in non-interfering relation with button 200. The button is accordingly in first operable state wherein it may mate contents 232 and 234 in trigger fashion whenever rotated counterclockwise. In this connection, button 200 is biased in clockwise sense by contact 232 or otherwise.

In FIG. 21, slide 218 has been moved from its FIG. 20 position into its FIG. 19 position. Now, however, since button 200 was held in its FIG. 20 second disposition, slide lugs 236 and 238 are seated to the left of button ears 208 and 210 and in confronting relation thereto, thus precluding clockwise rotation of button 200. Movement of slide 218 into its location is facilitated by openings 220 and 222, the former enabling lugs 236 and 238 to straddle button sidewalls 210 and 212 (FIG. 15) and the latter seating lug 214 or a part thereof. FIG. 21 accordingly represents a second operative state for button 200, wherein contacts 232 and 234 are in continuous contact despite subsequent release of button 200 by an operator.

Figure 22:
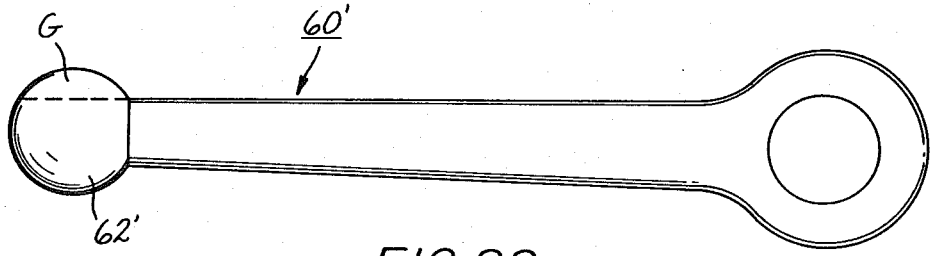
FIGS. 22 and 23 shows an alternate embodiment of a connecting rod for the pump shown in FIG. 1.
Figure 23:
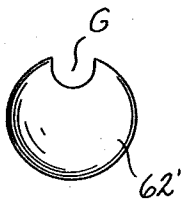
Figure 24:
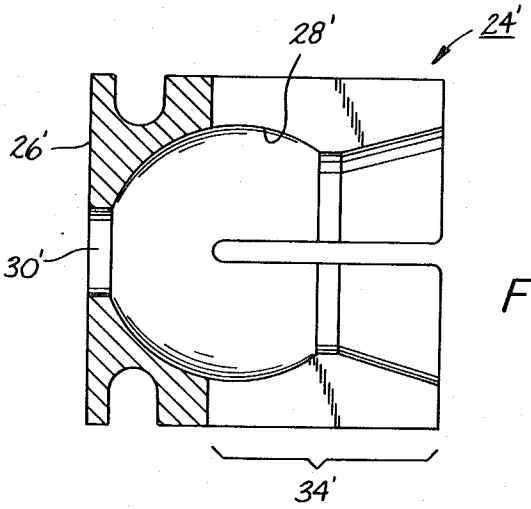
FIG. 24 shows an alternate embodiment of a piston for use with the connecting rod shown in FIGS. 22 and 23.
Figure 25:
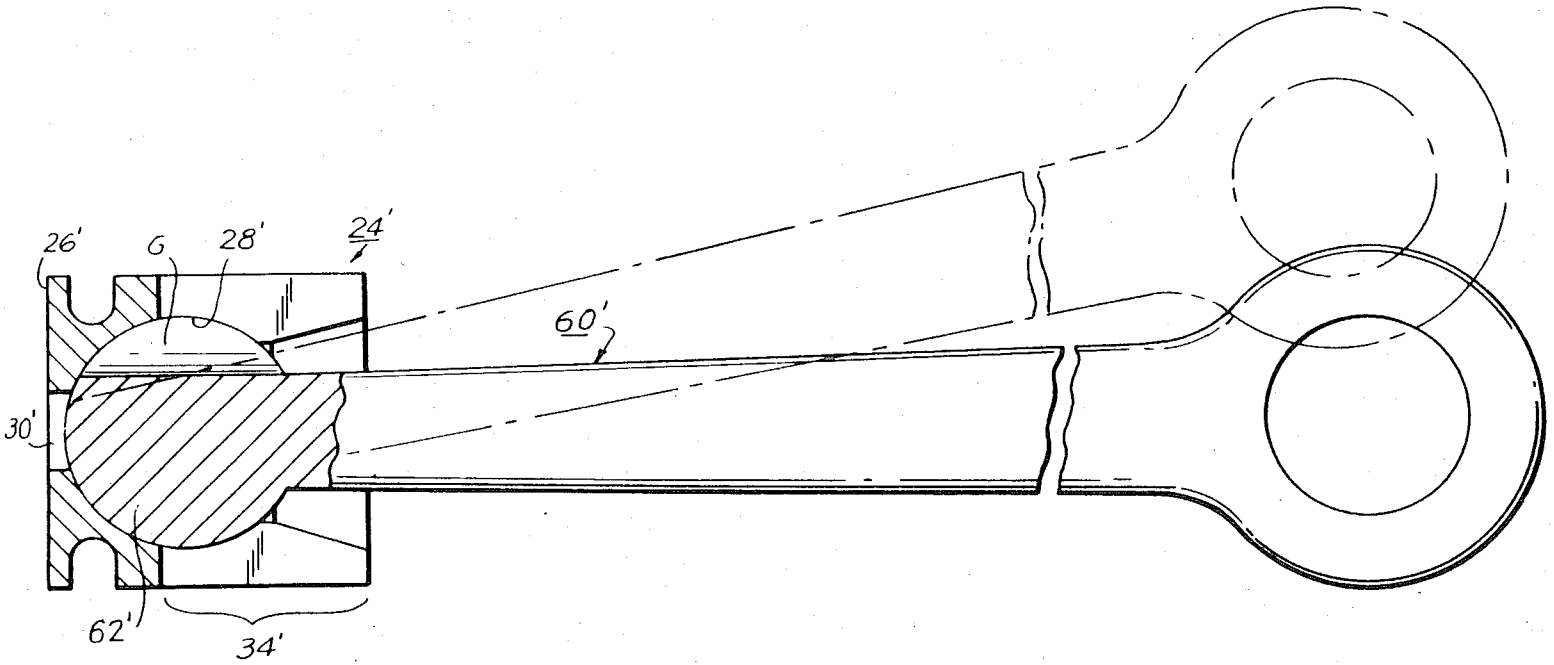
FIG. 25 is a partial sectional view of the piston and connecting rod of FIGS. 22 and 24 as assembled in the housing shown in FIG. 9.

FIGS. 22 and 23, respectively, show a plan view and an end view of an alternate embodiment of the connecting rod 60 of the pump embodiment discussed above with reference to FIGS. 1–21. FIG. 24 is a sectional view of an alternate embodiment of the piston 24 discussed above with reference to FIGS. 1–21 for use with the connecting rod shown in FIGS. 22 and 23.

Referring first to FIG. 24 a piston 24′ has a compression surface 26′ and a hollow spherical portion 28′. A passage 30′ extends through the compression surface 26′ into the hollow 28′. The hollow 28′ is bounded by piston tail portion 34′ which has four sections, as described above in connection with the piston 24.

FIG. 23 is a plan view of a connecting rod or driven member 60′ which includes a generally spherical knob member 62′ which closely fits inside the hollow 28′ in the piston 24′. The connecting rod 60′ includes a groove G which extends along the direction in which the piston moves when the pump is in operation. FIG. 23, which is an end view of the connecting rod 60′, shows the location of the groove G more clearly.

FIGS. 22 and 23, on one hand, and FIG. 24, on the other hand, are drawn to a different scale, so that the knob 62′ appears much smaller than the spherical hollow 28′. In fact, the diameter of the sperical hollow 28′ is substantially the same as or, as a result of manufacturing tolerances, only slightly larger than the diameter of the knob 62′. The piston 24′ and connecting rod 60′ are assembled as discussed above in connection with the piston 24 and connecting rod 60, with the knob 62′ inside the hollow 28′. The relative diameters of the knob 62′ and hollow 28′ provide a universal joint having virtually no "play". That is, rotation of the connecting rod 60′ relative to the piston 24′ is permitted in all directions, but linear relative movement between them is virtually impossible. The assembled piston 24′ and connecting rod 60′ fit into the pump as discussed above and particularly as shown in FIGS. 1 and 9.

In operation, during the compression stroke, or first course, of the piston, the groove G is out of communication with the flow passage 30′. As a result, the flow passage 30′ is sealed by the surface of the knob member 62′ and the fluid contents of the pump chamber are delivered to the outlet port of the pump. During the piston's return stroke, or second course, the groove G is placed into flow communication with the flow passage 30′. As a result, the compression surface 26′ of the piston 24′ is placed in flow communication with the pump inlet.

This alternative embodiment is advantageous because it operates more quietly than the embodiment discussed above. In that embodiment the relative axial movement between the piston 24 and connecting rod 60 during pump operation results in a distinct "clicking" sound at the end of each compression and return stroke as the connecting rod end portion hits the axial surfaces of the interior hollow portion of the piston. That clicking sound results in a hum when the pump is operating. This alternate embodiment eliminates the hum by substantially eliminating relative axial movement of the connecting rod and piston, and thus this alternate embodiment is preferred in cases where the advantages of the previously described embodiment need not be utilized.

Various modifications may evidently be introduced in the foregoing particularly discussed and illustrated embodiments and practices without departing from the invention. Accordingly, the preferred embodiments and practices are intended in an illustrative and not in a limiting sense. The true spirit and scope of the invention is set forth in the following claims.

What is claimed is:

1. Apparatus for compressing a fluid medium comprising a housing having fluid medium inlet and outlet ports, a piston supported for displacement in said housing, said piston defining a fluid compression surface and having a substantially hollow interior and a fluid flow passage extending through said piston and said fluid compression surface, said hollow interior being in fluid communication with said fluid flow passage a drive source, and driven means having a longitudinal axis, said driven means interconnecting said piston and said drive source and including valve means mounted within said hollow interior and formed with an exterior groove, said valve means comprising a knob member having an outer surface with a diameter substantially equal to the inner diameter of said hollow interior and disposed in said hollow interior of said piston for providing a joint connecting said driven means and said piston in driving relation, said exterior groove having a longitudinal flow axis and being formed in the other surface of said knob member so that said flow axis extends substantially parallel to the longitudinal axis of said driven means, said driven means displacing said piston alternately in first and second oppositely-directed strokes said piston resiliently enclosing said valve means and enabling limited relative rotation of said piston and said valve means with respect to each other as said piston is displaced in said first and second strokes, said relative rotation being such as to preclude flow communication through said exterior groove between said passage and said inlet port during said displacement of said piston in said first stroke and as to place said passage in flow communication with said inlet port through said exterior groove during said displacement of said piston in said second stroke.

2. Apparatus according to claim 1; wherein:
said hollow interior and said knob member are substantially spherical.

3. Apparatus according to claim 1; wherein said driven means and said piston jointly define a universal joint therebetween.

4. Apparatus according to claim 1; wherein said groove extends in the direction of displacement of said piston.

5. Apparatus according to claim 1; further comprising canister means connected thereto for containing a liquid and venturi means connected to said apparatus and to said canister means, said fluid medium as compressed by said apparatus being dischargeable past said venturi means in such a manner as to withdraw said liquid from said canister means.

6. Apparatus according to claim 1; further comprising canister means connected thereto for containing a liquid, said fluid medium as compressed by said apparatus being dischargeable into said canister means for pressurizing said liquid, further comprising outlet means formed in said canister means whereby said liquid is dischargeable.

7. Apparatus according to claim 6; wherein said liquid is foamable and said fluid medium as compressed by said apparatus is dischargeable into said canister means below the level of said liquid in such a manner as to aerate said liquid.

8. Apparatus according to claim 1, further comprising an operating button moveable between an operative position for operating said apparatus and an inoperative position for deactivating said apparatus and control slide means for locking said operating button in either of said positions.

* * * * *